US009322626B2

(12) United States Patent
Ballard

(10) Patent No.: US 9,322,626 B2
(45) Date of Patent: Apr. 26, 2016

(54) FIREARM WITH SHELL HOLDER

(71) Applicant: Michael W. Ballard, Cerritos, CA (US)

(72) Inventor: Michael W. Ballard, Cerritos, CA (US)

(73) Assignee: PRO MAG MFG., INC., Phoenix, AZ (US)

( * ) Notice: Subject to any disclaimer, the term of this patent is extended or adjusted under 35 U.S.C. 154(b) by 247 days.

(21) Appl. No.: 13/736,818

(22) Filed: Jan. 8, 2013

(65) Prior Publication Data

US 2014/0190058 A1 Jul. 10, 2014

(51) Int. Cl.
*F42B 39/00* (2006.01)
*F42B 39/02* (2006.01)
*F42B 39/26* (2006.01)

(52) U.S. Cl.
CPC ..... *F42B 39/02* (2013.01); *F42B 39/26* (2013.01)

(58) Field of Classification Search
CPC ..... F42B 39/02; F42B 39/00; F42B 39/24; F42B 39/26
USPC ..... 42/90; 89/34; 206/3; 224/931, 239
See application file for complete search history.

(56) References Cited

U.S. PATENT DOCUMENTS 3,153,500 A * 10/1964 Pachmayr et al. ..... 224/245
4,344,528 A * 8/1982 Perisastry et al. ..... 206/3
4,852,286 A * 8/1989 Troncoso et al. ..... 42/70.07
4,860,478 A * 8/1989 Clayton ..... 42/71.01
4,942,991 A * 7/1990 Lyons ..... 224/196
5,924,613 A * 7/1999 Johnson et al. ..... 224/195
6,962,278 B2 * 11/2005 Obatake ..... 224/681
2009/0282718 A1 * 11/2009 Bartley ..... 42/75.03
2011/0225864 A1 * 9/2011 Pullicar et al. ..... 42/71.01
2012/0285066 A1 * 11/2012 Chvala ..... 42/90

OTHER PUBLICATIONS

Midway USA, Mesa Tactical Sureshell Shotshell Ammunition 12 Gauge Mossberg 930 6-Round Aluminum, Sep. 26, 2011, pp. 1-6.*

* cited by examiner

*Primary Examiner* — Stephen M Johnson
*Assistant Examiner* — Benjamin Gomberg
(74) *Attorney, Agent, or Firm* — Langlotz Patent & Trademark Works, Inc.; Bennet K. Langlotz

(57) ABSTRACT

Shell holders for firearms have a body including a plurality of bores, a plurality of elastomeric elements, each associated with a different selected one of the bores, each elastomeric element having a protruding portion that protrudes a selected distance into the bore, a plurality of movable adjustment elements, each connected to the body and each operably engaged to a different selected one of the elastomeric elements, wherein the selected distance the protruding portion of the elastomeric element protrudes into the bore is adjustable based on an adjustment position of each adjustment element, and the selected distance is independently adjustable for each elastomeric element. The shell holder may be for a shotgun. The movable adjustment elements may include a plurality of jaws movable with respect to the body. There may be a gap defined between the body and each jaw. The elastomeric elements may be received within the gaps.

16 Claims, 9 Drawing Sheets

FIREARM WITH SHELL HOLDER

FIELD OF THE INVENTION

The present invention relates to firearms, and more particularly to a firearm having a shell holder mounted on the firearm's exterior.

BACKGROUND OF THE INVENTION

Shotguns are popular for use for hunting small, fast-moving targets, target shooting sports, and in close quarters combat or defense. One of the main disadvantages of shotguns is that a typical 12 gauge pump shotgun is limited to six or seven shots in the magazine tube and one in the chamber. This necessitates the need to carry additional shells for reloading. Furthermore, since a shotgun is slower to reload than a magazine-fed rifle, the shells must be readily accessible to avoid additional reloading time. However, the shells must also be retained within the carrier until they are needed without falling out.

A variety of prior art devices are known for attaching shells to the exterior of a shotgun. A typical receiver-mounted shell holder is the SureShell shotshell carrier manufactured by Mesa Tactical of Costa Mesa, Calif. The SureShell uses an elastomeric tube that partially protrudes into the shell carrier receptacles to retain shells within the receptacles until they are needed. The force required to remove a shell from a receptacle is not readily adjustable. Adjustability might be beneficial when a mission demands either high retention forces, or looser extraction forces, or based on the dimensional variations and surface conditions of the shells used. Adjustment of the SureShell device would require substituting either a stiffer (or softer) elastomeric tube or one that offers more or less dimensional interference. Because of the repeated friction, elastomeric tubes are subject to wear. They may also require the user to adopt a twisting motion of the shell in order to more quickly and reliably remove a shell from the carrier, which may present limitations for some users.

Therefore, a need exists for a new and improved firearm with shell holder that allows the user to adjust the amount of force required to remove a shell from each individual receptacle of the shell holder. In this regard, the various embodiments of the present invention substantially fulfill at least some of these needs. In this respect, the firearm with shell holder according to the present invention substantially departs from the conventional concepts and designs of the prior art, and in doing so provides an apparatus primarily developed for the purpose of allowing adjustment of the amount of force required to remove a shell from each individual receptacle of the shell holder.

SUMMARY OF THE INVENTION

The present invention provides an improved firearm with shell holder, and overcomes the above-mentioned disadvantages and drawbacks of the prior art. As such, the general purpose of the present invention, which will be described subsequently in greater detail, is to provide an improved firearm with shell holder that has all the advantages of the prior art mentioned above.

To attain this, the preferred embodiment of the present invention essentially comprises a body including a plurality of bores, a plurality of elastomeric elements, each associated with a different selected one of the bores, each elastomeric element having a protruding portion that protrudes a selected distance into the bore, a plurality of movable adjustment elements, each connected to the body and each operably engaged to a different selected one of the elastomeric elements, wherein the selected distance the protruding portion of the elastomeric element protrudes into the bore is adjustable based on an adjustment position of each adjustment element, and the selected distance is independently adjustable for each elastomeric element. The shell holder may be for a shotgun. The movable adjustment elements may include a plurality of jaws movable with respect to the body. There may be a gap defined between the body and each jaw. The elastomeric elements may be received within the gaps. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
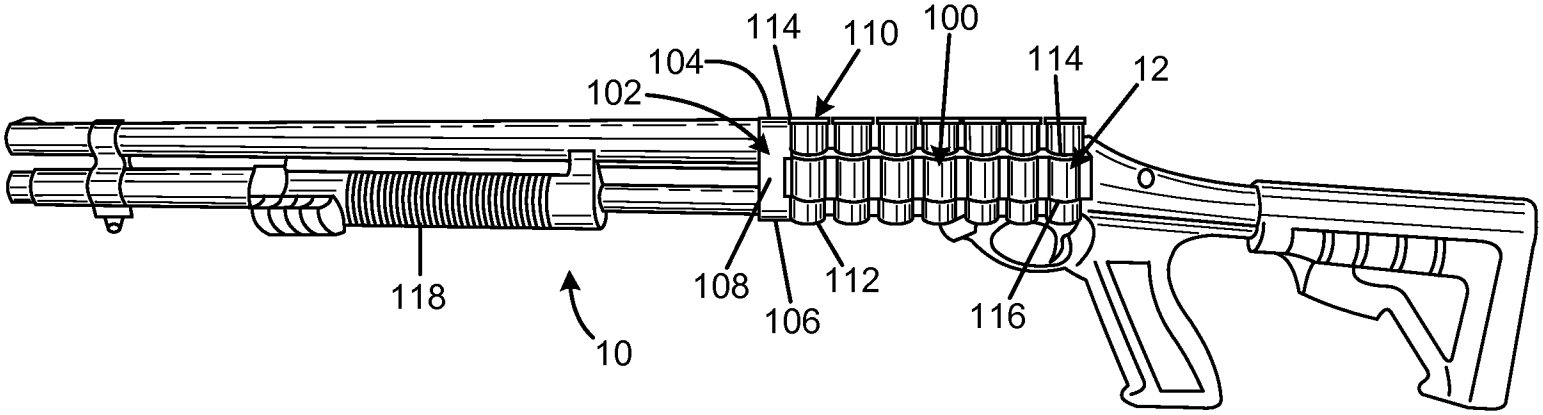
FIG. 1 is a left side view of the current embodiment of the firearm with shell holder constructed in accordance with the principles of the present invention with the shells inserted front down.

An embodiment of the firearm with shell holder of the present invention is shown and generally designated by the reference numeral 10.

Figure 2:
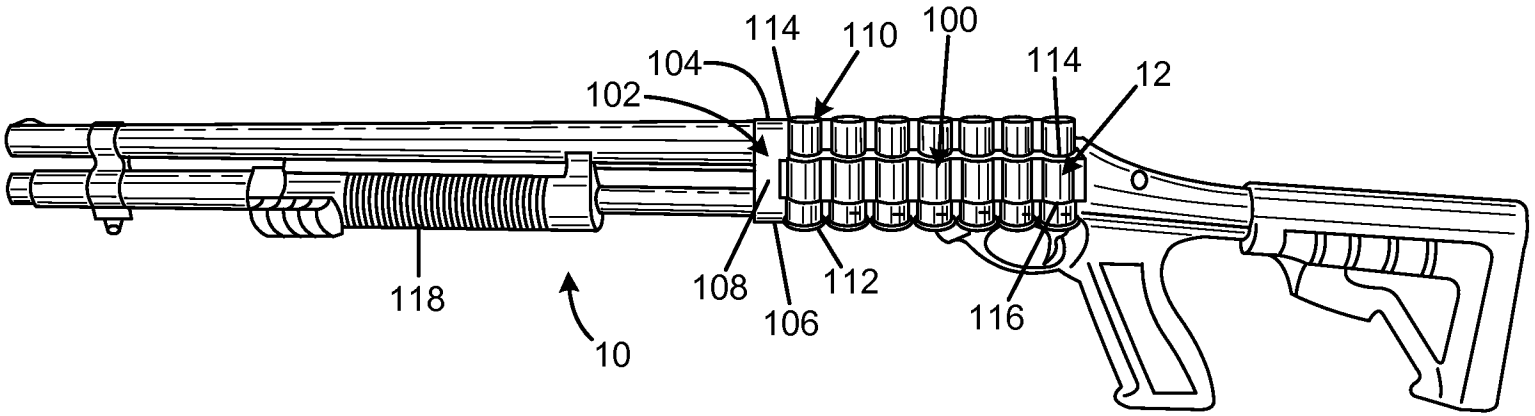
FIG. 2 is a left side view of the current embodiment of the firearm with shell holder of FIG. 1 with the shells inserted front up.

FIGS. 1 and 2 illustrate the improved firearm with shell holder 10 of the present invention. More particularly, the firearm is a shotgun having a receiver 102 and a pump action forend 118. The receiver has a top 104, bottom 106, and left side 108. The shotgun may be a Remington® 870™ 12 gauge shotgun with a military length forend manufactured by Remington Arms Company, LLC of Madison, N.C. In alternative configurations employing the same concepts, other types of shotgun receivers and forends, including shotguns of other gauges, may be employed.

A shell holder 100 is attached to the left side 108 of the receiver 102. The shell holder has seven shell receptacles 12. The quantity of shell receptacles is selected to provide the maximum number possible without contacting or interfering with the pump action forend 118. Each shell receptacle receives a shell 110 having a front 112 and a rear 114. The shells can be inserted front down (brass up) into the shell receptacles as shown in FIG. 1 or front up (brass down) as shown in FIG. 2, depending on the user's preference. Furthermore, unlike the prior art SureShell carrier, the adjustability of the present invention ensures shells are securely held equally in both configurations.

Figure 3:
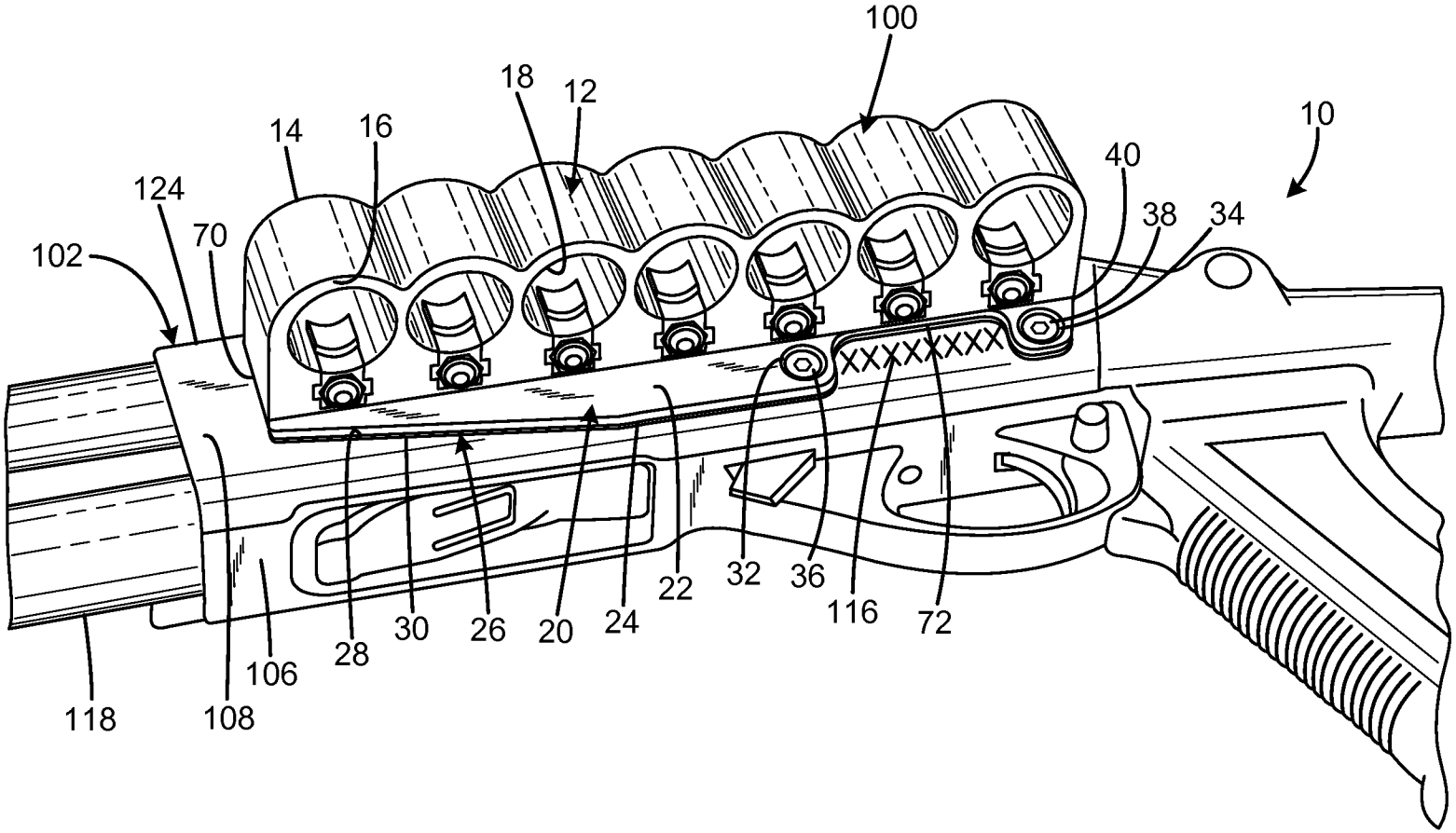
FIG. 3 is an enlarged bottom isometric partial view of the current embodiment of the firearm with shell holder of FIG. 1.

FIG. 3 illustrates the improved firearm with shell holder 10 of the present invention. More particularly, the receiver 102 has been enlarged relative to FIGS. 1 and 2 so that the attachment features of the shell holder 100 can be better appreciated. The shell holder has seven shell receptacles 12 that extend outwardly from the left 108 of the receiver from the top 22 of a mounting plate 20. The bottom 24 of the mounting plate abuts the top 28 of a gasket 26. The gasket has a bottom 30 that contacts the left side of the receiver. In the current embodiment, the gasket is made of rubber and is the only part of the shell holder that contacts the receiver, so the surface of the receiver contacted by the shell holder remains unmarred if the shell holder is removed. The mounting plate is made of anodized aluminum in the current embodiment, and the remainder of the shell holder is constructed of carbon fiber-filled polymer in the current embodiment.

Each shell receptacle has a top 14, a bottom 16, and a central bore 18. The additional features of the shell receptacles will be described in the discussion of the subsequent Figures. The shell receptacles 12 extend continuously from the front 70 of the mounting plate 20 to the rear 40 of the mounting plate. A portion of the mounting plate and gasket 26 extend towards the bottom 106 of the receiver 102 below the shell receptacles. Two apertures 32, 34 are positioned at the rear of the mounting plate and are separated by an indentation 72. The gasket has corresponding apertures that are not visible. The indentation 72 provides a window for viewing the firearm's serial number 116 without requiring removal of the shell holder 100. The apertures in the mounting plate and gasket are axially registered with the front and rear trigger pin apertures (not visible) of the firearm. The apertures each receive a bolt 36, 38 that replace the front and rear trigger pins of the firearm and removably attach the shell holder to the left side 108 of the receiver.

Figure 4:
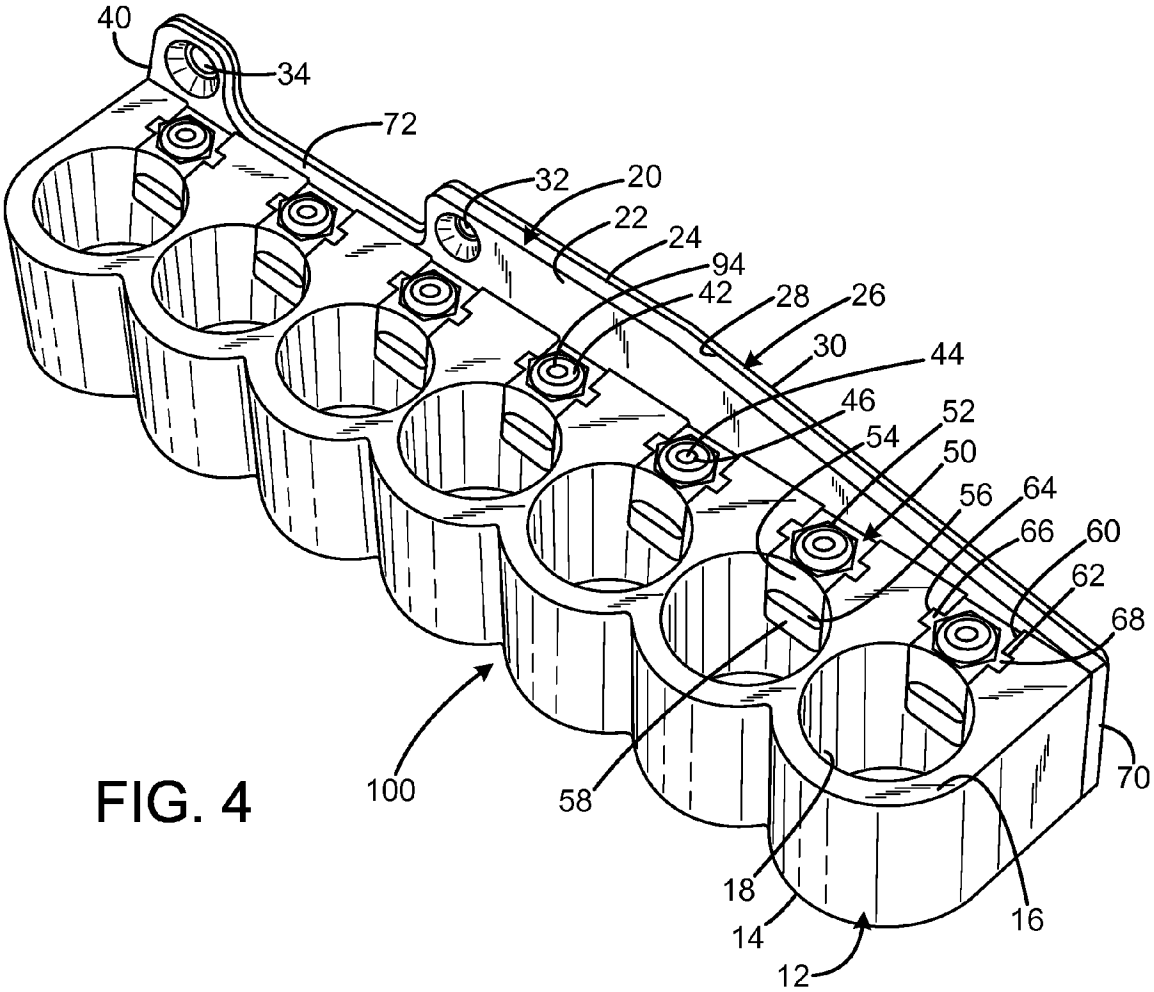
FIG. 4 is a bottom isometric view of the current embodiment of the shell holder of FIG. 1 removed from the firearm.

FIG. 4 illustrates the shell holder 100. More particularly, the shell holder is shown removed from the firearm with the bottom 16 of the shell receptacles 12 visible. Each shell receptacle has a major slot 60 that communicates between the top 22 of the mounting plate 20 and the bore 18 in the shell receptacle. Each major slot has two minor slots 62, 64 that extend outwardly parallel to the mounting plate. The slots each receive an elastomer 56 and a jaw 50, with the elastomer positioned between the jaw and the bottom of the shell receptacle. A protruding portion 58 of the elastomer extends into the bore in the shell receptacle. The bottom portion of each jaw forms a hexagonal aperture 52 that receives a hexagonal locknut 42. Each locknut has an aperture 94 that threadedly receives the threaded end 46 of an adjustment bolt 44. In the current embodiment, the locknut is a nylon insert locknut. Additional features of the elastomer, jaw, locknut, and adjustment bolt will be described in the discussion of the subsequent Figures.

Figure 5:
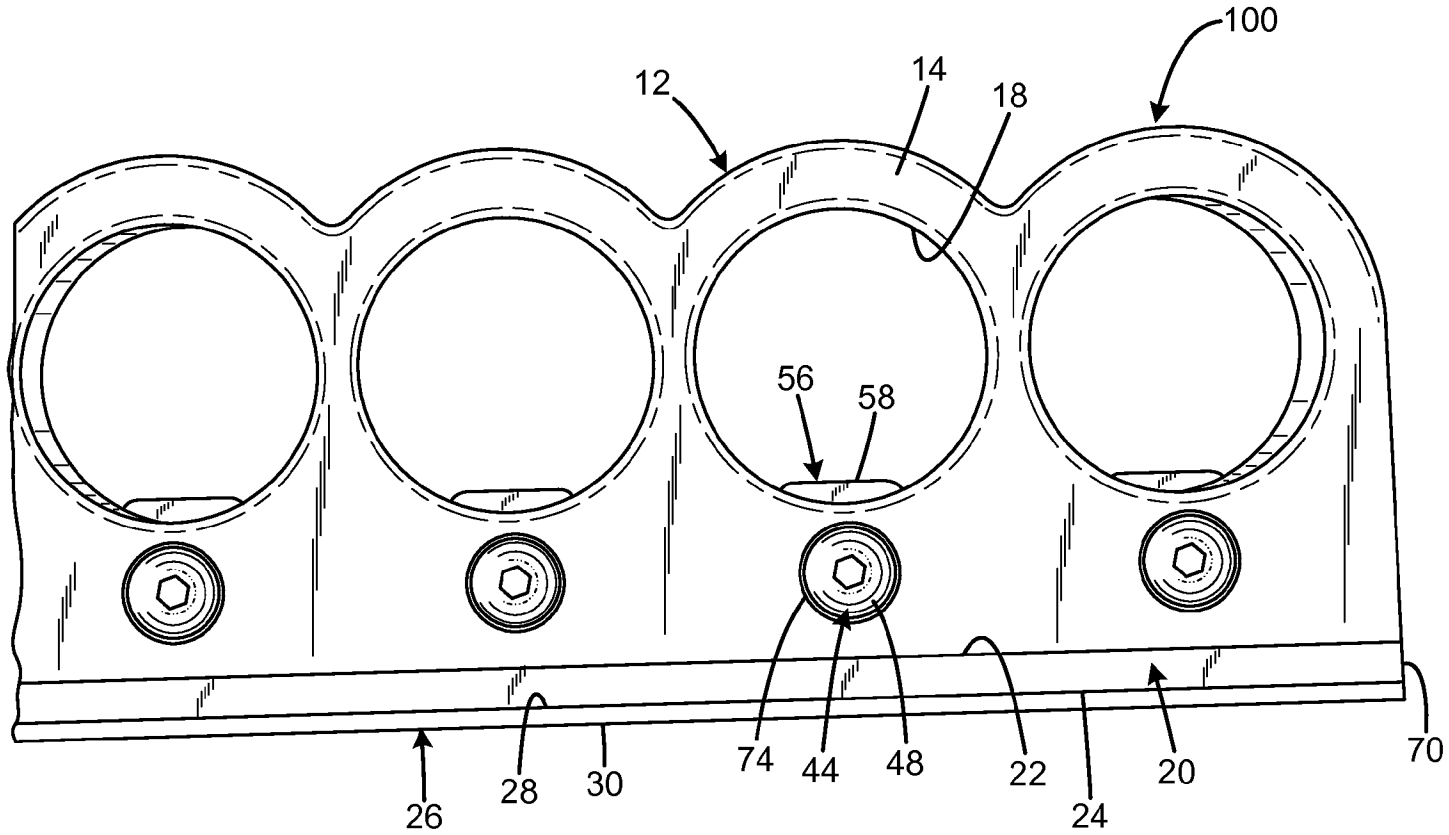
FIG. 5 is a top side partial view of the current embodiment of the shell holder of FIG. 1 removed from the firearm.

FIG. 5 illustrates the shell holder 100. More particularly, the shell holder is shown removed from the firearm with the top 14 of the shell receptacles 12 visible. Each shell receptacle has an adjacent aperture 74 positioned between the shell receptacle and the top 22 of the mounting plate 20. Each aperture 74 receives the head 48 of one of the adjustment bolts 44.

Figure 6:
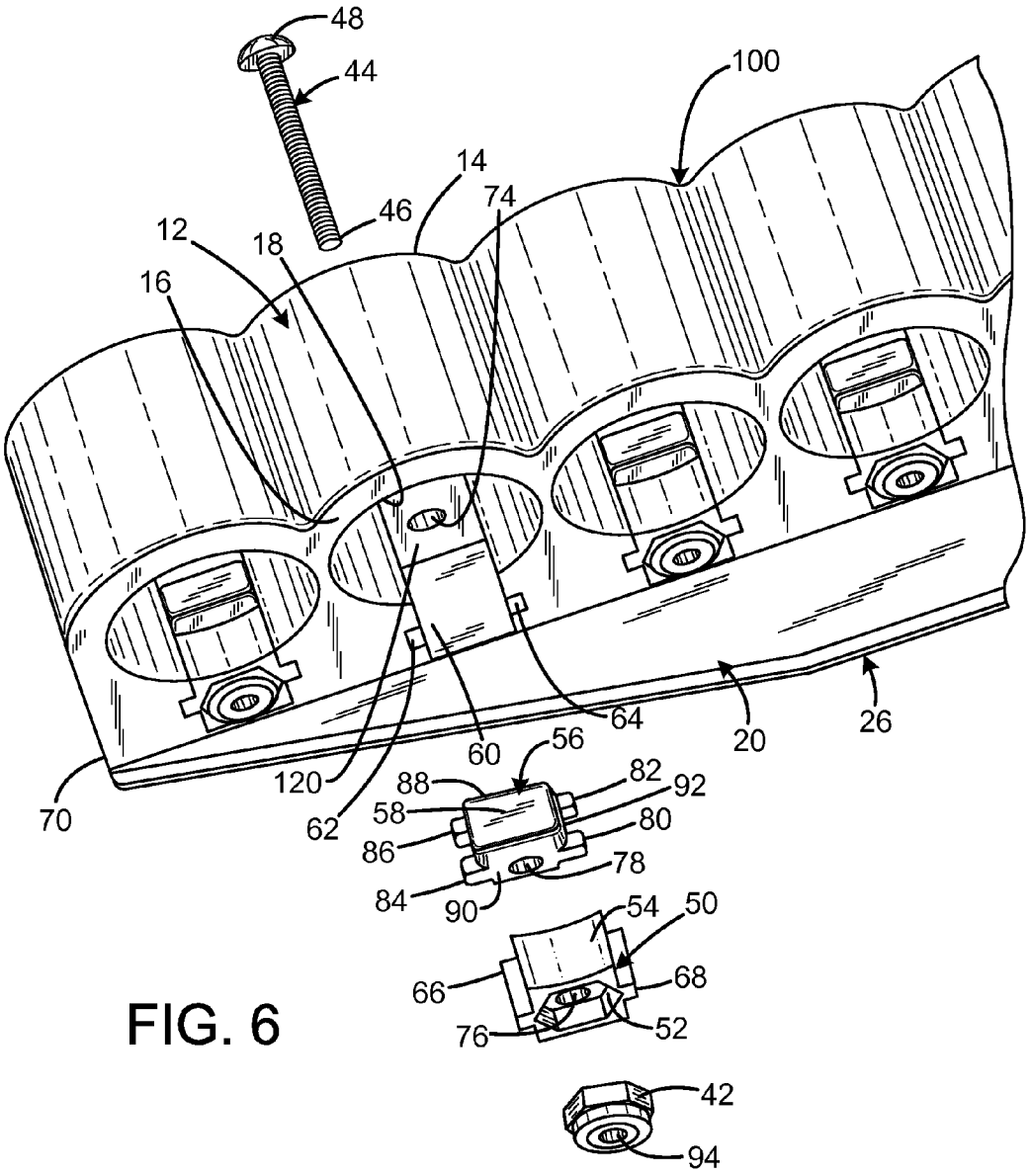
FIG. 6 is a bottom exploded partial view of the current embodiment of the shell holder of FIG. 1 removed from the firearm.
Figure 7:
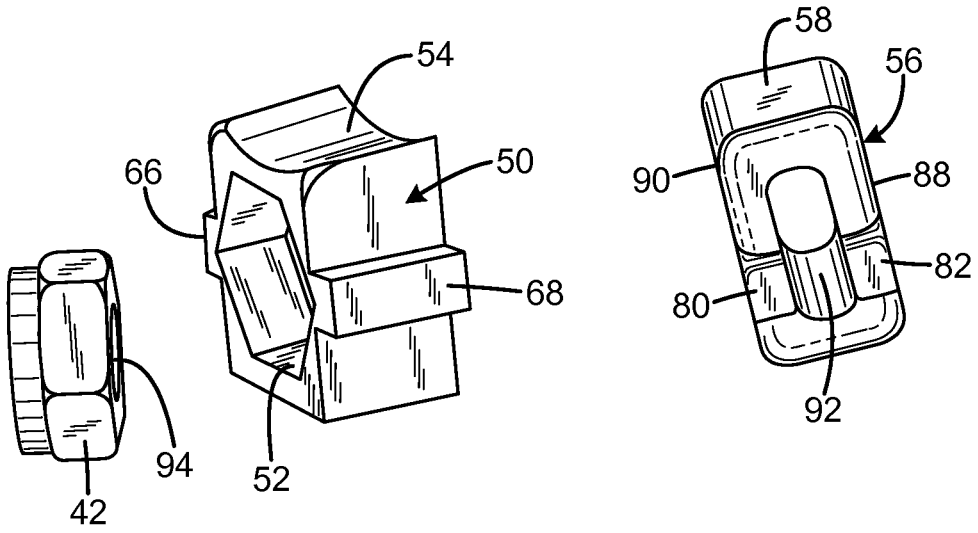
FIG. 7 is a right side exploded view of the current embodiment of the locknut, jaw, and elastomer of FIG. 1 removed from the shell holder.

FIG. 6 illustrates the shell holder 100 with an adjustment bolt 44, elastomer 56, jaw 50, and locknut 42 removed. FIG. 7 illustrates additional features of the adjustment bolt, jaw, and elastomer. The aperture 74 that receives an adjustment bolt 44 communicates between the top 14 of the shell holder and the major slot 60 to permit passage of the threaded end 46 of the adjustment bolt into the major slot. The elastomer 56 has an aperture 78 to permit passage of the threaded end of the adjustment bolt through the elastomer. The jaw 50 has an aperture 76 that communicates with the hex aperture 52 in the jaw to permit passage of the threaded end of the adjustment bolt through the jaw. The threaded aperture 94 in the locknut 42 receives the threaded end of the adjustment bolt.

The elastomer 56 has ears 80, 82 on the top 88 and ears 84, 86 on the bottom 90. The ears of the elastomer are received in the minor slots 62, 64 and prevent rotational movement of the elastomer within the major slot 60. The elastomer has a central aperture 92 that effectively renders the elastomer hollow and highly compressible. If the elastomer were solid, the elastomer would resist compression and perhaps even experience damage before sufficient extrusion into the bore 18 occurred. The jaw 50 has ears 66, 68 that are received in the minor slots and prevent rotational movement of the jaw within the major slot. The jaw has a curved portion 54 that has the same radius of curvature as the bore of the shell receptacle 12. Both the curved portion of the jaw and the bore of the shell receptacle have a radius of curvature selected to closely conform to the exterior of a 12 gauge shotgun shell 110.

To assemble the components of a shell receptacle 12, first the ears 80, 82, 84, and 86 of the elastomer 56 are inserted into the minor slots 62, 64. The elastomer is inserted into the major slot 60 such that the protruding portion 58 extends outward into the bore 18 of the shell receptacle 12. The elastomer is pressed into the major minor slots until the top 88 of the elastomer contacts the top 120 of the major slot. In this position, the aperture 78 of the elastomer is axially registered with the aperture 74 adjacent to the shell receptacle. Subsequently, the jaw is inserted into the major slot with the ears 66, 68 in the minor slots and the curved portion 54 facing towards the bore of the shell receptacle. Once the jaw abuts the bottom 90 of the elastomer, with the aperture 76 of the jaw axially registered with the aperture 78 of the elastomer, a locknut 42 is inserted into the hex aperture 52 of the jaw. The aperture 94 in the locknut is axially registered with the aperture 76 of the jaw. Finally, the threaded end 46 of an adjustment bolt 44 is inserted through the apertures 74, 78, 76, and threadably engaged by the aperture 94. Once the threaded end of the adjustment bolt is threadably engaged with the locknut, the components of the shell receptacle are fixed in position unless the adjustment bolt is rotated. The elastomer is effectively received within an adjustable gap 122 (shown in FIG. 9) between the top of the major slot and the jaw.

Figure 8:
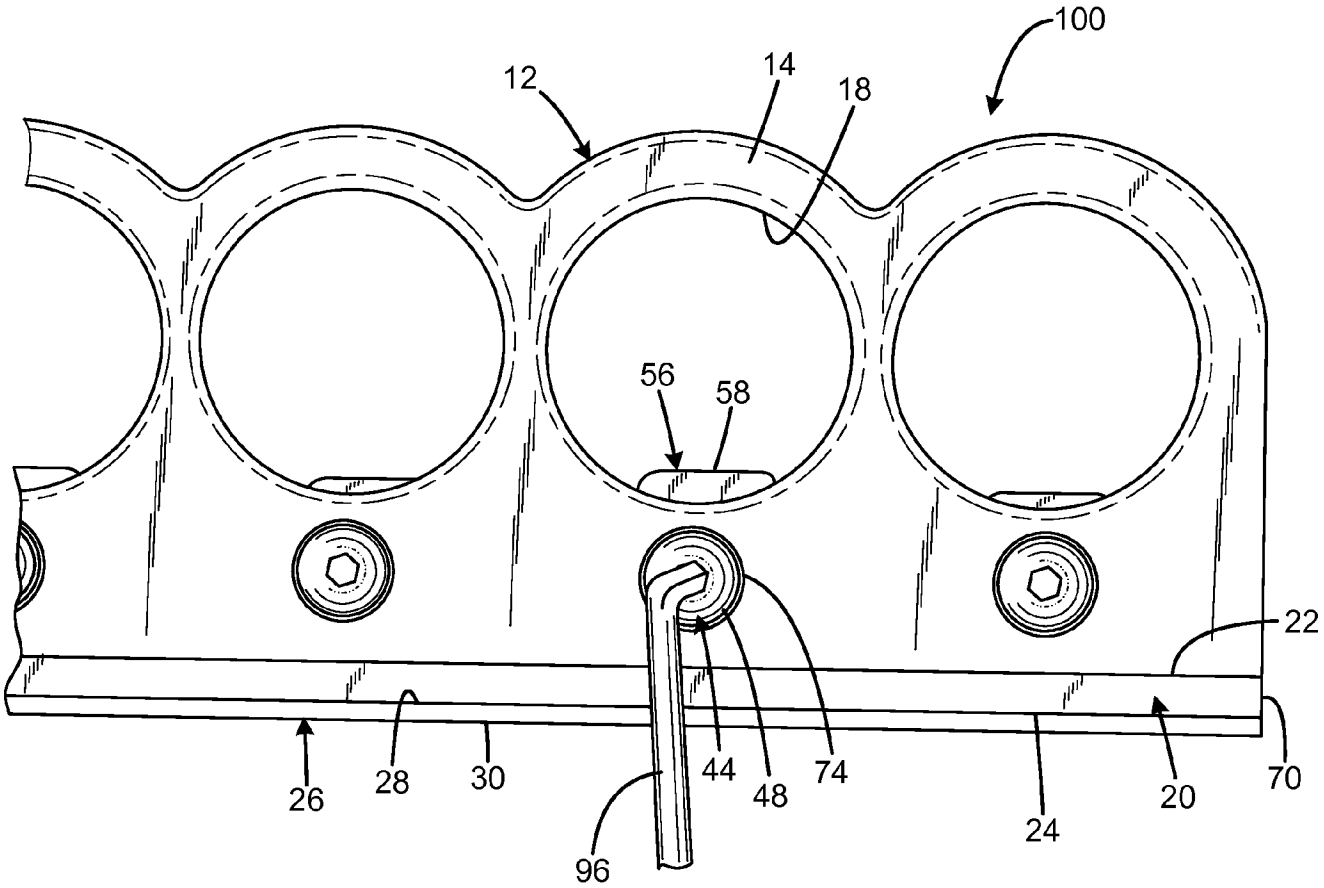
FIG. 8 is a top partial view of the current embodiment of the shell holder removed from the firearm with a hex key having tightened an adjustment screw.
Figure 9:
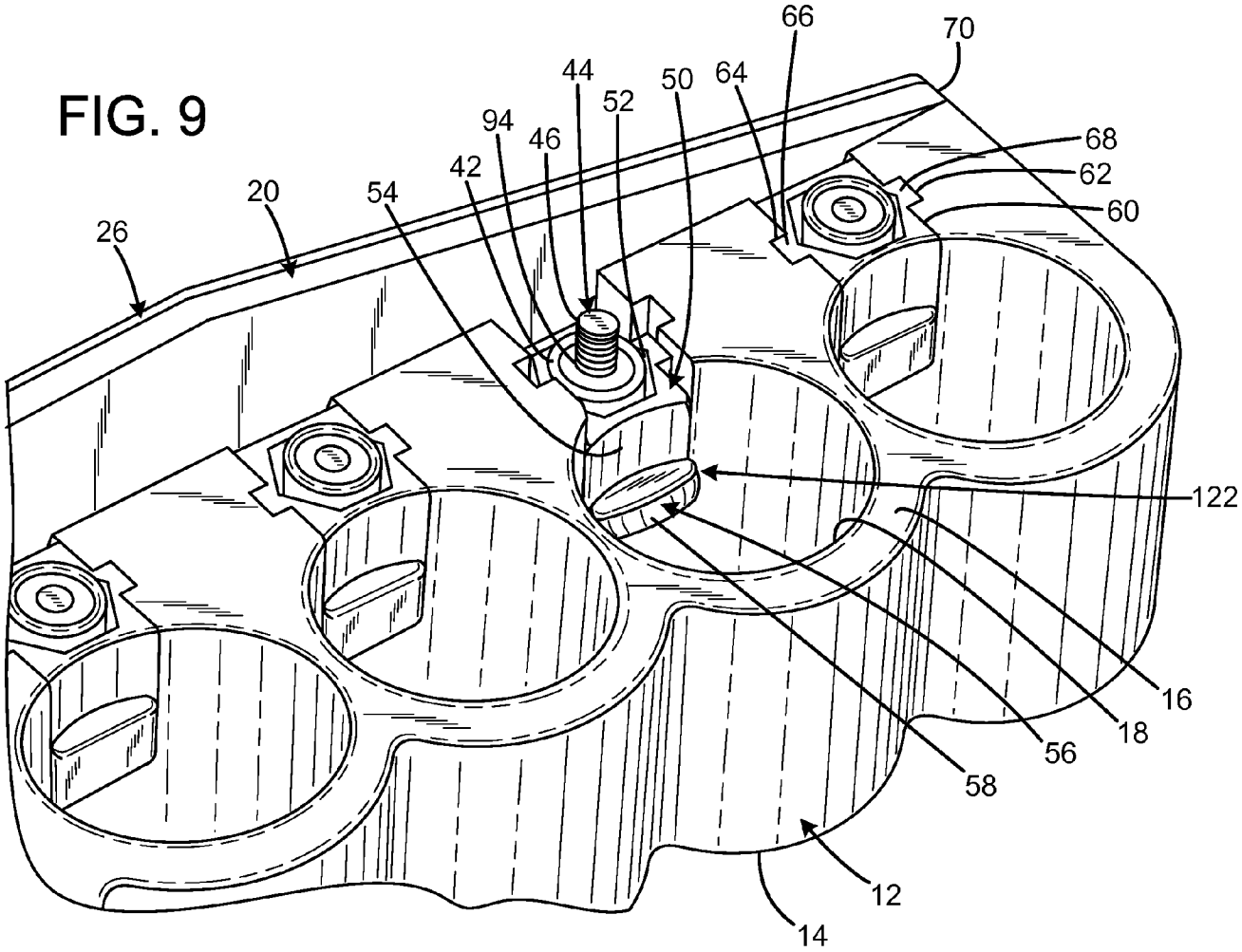
FIG. 9 is a bottom isometric partial view of the current embodiment of the shell holder of FIG. 8 showing the effects of the adjustment to the adjustment screw.

FIGS. 8-9 illustrate the engagement of a hex key 96 with the head 48 of an adjustment bolt 44. More particularly, the adjustability of the amount of force required to remove a shell 110 from an individual shell receptacle 12 is depicted. In FIGS. 8-9, the amount of force required to remove a shell from the shell receptacle that is immediately adjacent to the forwardmost shell receptacle has been increased by rotating the hex key clockwise.

The clockwise rotation of the hex key 96 has drawn the locknut upward onto the threaded end 46 of the adjustment bolt 44. As the locknut is drawn upward, the locknut urges the jaw 50 upward as well. As a result, the gap 122 between the jaw and the top 120 of the major slot 60 decreases. As the gap decreases, the elastomer 56 is compressed as the aperture 92 in the elastomer closes. As a result, the protruding portion 58 of the elastomer 56 is extruded outward into the bore 18 of the shell receptacle 12 and obstructs a larger portion of the bore than was the case before the adjustment bolt was tightened. A comparison of the degree of protrusion of the protruding portions of the elastomers in FIGS. 8-9 clearly shows the effects of the adjustment bolt tightening. Similarly, the amount of the bore the protruding portion of the elastomer obstructs can be decreased by loosening the adjustment bolt, provided the threaded end of the adjustment bolt is not completely disengaged from the aperture 94 of the locknut.

Because each shell receptacle 12 has an adjustment bolt 44, and elastomer 56, a jaw 50, and a locknut 42, the user can adjust the individual tension exerted on a shell 110 for each shell receptacle independently. This enables the fine-tuning of each shell receptacle for the specific type of ammunition it will contain and the level of retention required. Furthermore, in the event an elastomer experiences wear, the elastomer's usable life can be extended simply by tightening the associated adjustment bolt to restore the previous level of retention. At the end of the elastomer's service life, it can be readily replaced by removing the associated adjustment bolt.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a firearm with shell holder has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shell holder for a firearm having a mounting facility, the shell holder comprising:

a body including a plurality of bores each defining a bore axis;

a plurality of elastomeric elements, each associated with a different selected one of the bores;

each elastomeric element having a protruding portion that protrudes a selected and continuously adjustable distance into the bore responsive to compression of the elastomeric element; and a plurality of movable adjustment elements, each connected to the body outside of the bores and each operably engaged to a different selected one of the elastomeric elements to compress the associated elastomeric element in a direction substantially parallel to the bore axis;

wherein the selected distance the protruding portion of an elastomeric element protrudes into the bore is adjustable through a range of protrusion amounts based on an adjustment position of an associated adjustment element, and the selected distance is independently adjustable for each elastomeric element;

wherein the adjustment position is fixed relative to radial outward force exerted upon the elastomeric element for all adjustment positions; and wherein the elastomeric element is positioned at one side of the bore, so as to provide an eccentric lateral force on a shell.

2. The shell holder of claim 1 wherein the shell holder is mounted on a shotgun.

3. The shell holder of claim 1 further comprising:

the movable adjustment elements each including a jaw movable with respect to the body;

a gap defined between the body and each jaw; and the elastomeric elements being received within the gaps such that the elastomeric elements are compressed between the jaws and the body.

4. The shell holder of claim 3 wherein movement of a selected one of the jaws towards the body narrows the associated gap and increases the distance the protruding portion of the associated elastomeric element protrudes into the associated bore by compressing the elastomeric element.

5. The shell holder of claim 3 wherein movement of a selected one of the jaws away from the body widens the associated gap and decreases the distance the protruding portion of the associated elastomeric element protrudes into the associated bore by expansion of the elastomeric element.

6. The shell holder of claim 3 further comprising the movable adjustment elements each including a fastener that selectively positions each jaw with respect to the body.

7. The shell holder of claim 6 wherein each fastener is a bolt threadably engaged with a locknut.

8. The shell holder of claim 1 wherein each elastomeric element has a central aperture that increases the compressibility of the elastomeric element by rendering the elastomeric element hollow.

9. The shell holder of claim 1 wherein the mounting facility comprises holes for receiving front and rear trigger pins of a firearm when the shell holder is mounted on the firearm.

10. A shell holder for a firearm having a mounting facility, the shell holder comprising:

a body including a plurality of bores, each having an interior space and defining a bore axis;

a plurality of jaws movable with respect to the body, each associated with a different selected one of the bores;

a gap defined between the body and each of the jaws;

a plurality of elastomeric elements, each received by a different selected one of the gaps;

a portion of each elastomeric element protruding, in a protrusion direction, a distance into an associated one of the bores responsive to compression of the elastomeric element in a direction substantially perpendicular to the protrusion direction; and a plurality of fasteners to selectively position the jaws over a range of positions to compress the elastomeric elements with respect to the body such that the distance the elastomeric elements protrude into the associated bores is continuously adjustable over a range of protrusion amounts by the fasteners;

wherein the elastomeric element is positioned at one side of the bore, so as to provide an eccentric lateral force on a shell.

11. The shell holder of claim 10 wherein the protruding portion of each elastomeric element defines a portion of the interior space of each of the associated bores.

12. The shell holder of claim 10 further comprising:

the elastomeric elements each having a main wall facing the body;

the elastomeric elements each having an opposing wall facing the associated jaw; and wherein a selected elastomeric element compresses and a portion of the selected elastomeric element is extruded into the associated bore as the associated fastener positions the associated jaw closer to the body and narrows the associated gap.

13. The shell holder of claim 10 further comprising:

the elastomeric elements having a main wall facing the body;

the elastomeric elements having an opposing wall facing the associated jaw; and wherein a selected elastomeric element expands and a portion of the elastomeric element retreats from the bore as the associated fastener positions the associated jaw farther from the body and widens the associated gap.

14. The shell holder of claim 10 wherein each fastener is a bolt threadedly engaged with a locknut.

15. The shell holder of claim 10 wherein the shell holder is mounted on a shotgun.

16. The shell holder of claim 10 further comprising:

wherein the facility comprises holes for receiving front and rear trigger pins of a firearm when the shell holder is mounted on the firearm;

the shell holder having a mounting plate including apertures that are axially registered with the holes; and each aperture receiving a screw that also passes through one of the holes and replaces the corresponding trigger pin of the firearm.

* * * * *